US009592989B2

(12) United States Patent
Herrmann

(10) Patent No.: US 9,592,989 B2
(45) Date of Patent: Mar. 14, 2017

(54) HIGH SPEED MULTI-BIN CARD COLLATION SYSTEM

(71) Applicant: XEROX CORPORATION, Norwalk, CT (US)

(72) Inventor: Douglas K Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/699,186

(22) Filed: Apr. 29, 2015

(65) Prior Publication Data

US 2016/0318730 A1 Nov. 3, 2016

(51) Int. Cl.

| | |
|---|---|
| ***B65H 31/30*** | (2006.01) |
| ***B65H 29/34*** | (2006.01) |
| ***B65H 39/115*** | (2006.01) |
| ***B65H 29/26*** | (2006.01) |

(52) U.S. Cl.

CPC ..... *B65H 39/115* (2013.01); *B65H 29/26* (2013.01); *B65H 29/34* (2013.01); *B65H 31/3009* (2013.01); *B65H 31/3054* (2013.01); *B65H 2701/1914* (2013.01)

(58) Field of Classification Search

CPC .... B65H 31/24; B65H 31/30; B65H 31/3009; B65H 31/3018; B65H 31/3054; B65H 31/3063; B65H 39/115; B65H 33/14; B65H 33/16; B65H 29/58; B65H 29/60; B65H 29/26; B65H 29/34

See application file for complete search history.

(56) References Cited

U.S. PATENT DOCUMENTS

| | | | | |
|---|---|---|---|---|
| 5,097,960 | A * | 3/1992 | Tilles | B07C 3/06 209/584 |
| 5,235,883 | A * | 8/1993 | Jeske | B07C 5/36 271/303 |
| 5,346,206 | A * | 9/1994 | Steinhart | B65H 29/60 271/182 |
| 5,740,921 | A * | 4/1998 | Yamashita | B07C 3/02 209/584 |
| 6,126,017 | A * | 10/2000 | Hours | B07C 3/008 198/370.03 |
| 7,052,006 | B2 * | 5/2006 | Stauber | B65H 33/04 270/58.31 |
| 8,770,911 | B2 | 7/2014 | Webb | |
| 8,899,567 | B2 * | 12/2014 | Nagayama | B65H 29/60 270/21.1 |
| 9,334,138 | B1 * | 5/2016 | Herrmann | B65H 39/115 |

OTHER PUBLICATIONS

U.S. Appl. No. 14/523,963, filed Oct. 27, 2014 and titled Taped Media Imposition for Adhesive In-Store Signage.

(Continued)

*Primary Examiner* — Luis A Gonzalez

(57) ABSTRACT

An automated high speed multi-bin card collation system that takes die cut greeting cards at high speeds and diverts them on a customer by customer basis into multiple bins. A series of diverters are included that actuate between customer jobs to divert and collate the jobs independently into the bins. Each bin has a retractable floor that allows the individualized jobs to be collated prior to dropping onto a conveyor system. The conveyor then conveys the collated card jobs to a downstream location.

14 Claims, 10 Drawing Sheets

(56) References Cited

OTHER PUBLICATIONS

U.S. Appl. No. 14/524,018, filed Oct. 27, 2014 and titled Variable Guide System for Shingling In-Store Adhesive Signage.
U.S. Appl. No. 14/582,426, filed Dec. 24, 2014 and titled Multi-Stage Collation System and Method for High Speed Compiling of Sequentially Ordered In-Store Signage.
U.S. Appl. No. 14/594,711, filed Jan. 12, 2015 and titled Collation System With Retractable Guides.
U.S. Appl. No. 14/699,196, filed Apr. 29, 2015 and titled High Speed Multi-Bin Card Collation and Buffering System.

* cited by examiner

HIGH SPEED MULTI-BIN CARD COLLATION SYSTEM

BACKGROUND OF THE INVENTION

Field of the Invention

The presently disclosed embodiments are directed to providing a collation system, more particularly to a fully automated collation system that is capable of collating cards at high speed (e.g., 24,000/hr.).

Description of the Related Art

Currently, greeting cards are produced by tying high speed die cutters to high speed sheet feeders and continuously feeding up to 24,000 cards per hour in a 2-up configuration with 8 cards (4 per left and right side). The cards need to be delivered to customers in collated and banded stacks. Now, the output of the cards is shingled and manually collated in accordance with each customer's order and each order is manually banded. Usually, the demand for the cards is highly cyclical and to accommodate dramatic fluctuation in demand temporary workers are added at peak times. This causes several issues including: the high use of temporary workers to collate, band and sort the cards into sets; difficulty in locating and hiring the temporary workers; and defects introduced by the workers into the product (missed or incorrectly collated or banded sets).

Moreover, current greeting card collating, banding and sorting systems are dependent on temporary worker actions which are less predictable than an automated system. Examples of signage production and signage cutting/collating systems are described in U.S. patent application Ser. No. 14/523,963, filed on Oct. 27, 2014, US Publication No. 2016-0114567, now U.S. Pat. No. 9,475,267 and titled TAPED MEDIA IMPOSITION FOR ADHESIVE IN-STORE SIGNAGE, U.S. patent application Ser. No. 14/524,018, filed on Oct. 27, 2014, now U.S. Pat. No. 9,126,761, and titled VARIABLE GUIDE SYSTEM FOR SHINGLING IN-STORE ADHESIVE SIGNAGE, U.S. patent application Ser. No. 14/582,426, filed on Dec. 24, 2014, now U.S. Pat. No. 9,463,945 and titled MULTI-STAGE COLLATION SYSTEM AND METHOD FOR HIGH SPEED COMPILING OF SEQUENTIALLY ORDERED IN-STORE SIGNAGE, U.S. patent application Ser. No. 14/594,711, filed on Jan. 12, 2015, now U.S. Pat. No. 9,463,946 and titled COLLATION SYSTEM WITH RETRACTABLE GUIDES, along with U.S. Pat. No. 9,334,138, titled HIGH SPEED MULTI-BIN CARD COLLATION AND BUFFERING SYSTEM.

A conventional system that collates products is shown in U.S. Pat. No. 8,770,911 B2 that includes a collating conveyor that receives products sequentially from a delivery point and collates them into groups. A pusher transfers the groups of products from the conveyor to a receiving trough.

Therefore, in view of the known prior art, there is a still a need for a cost effective solution that will alleviate personnel demands for high speed greeting card lines.

SUMMARY OF THE INVENTION

A solution in answer to this need is disclosed hereinafter that includes an automated high speed multi-bin card collation system that takes die cut greeting cards at high speeds and diverts the cards on a customer by customer basis into multiple bins. A series of diverters are included that actuate between customer jobs to divert and collate the jobs independently into the bins. Each bin has a removable floor that allows the individualized jobs to be collated prior to dropping onto a conveyor. The conveyor then actuates and the collated cards are conveyed out from under the bins to a downstream position or directly to a bander's open bins.

BRIEF DESCRIPTION OF THE DRAWINGS

Various of the above-mentioned and further features and advantages will be apparent to those skilled in the art from the specific article or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
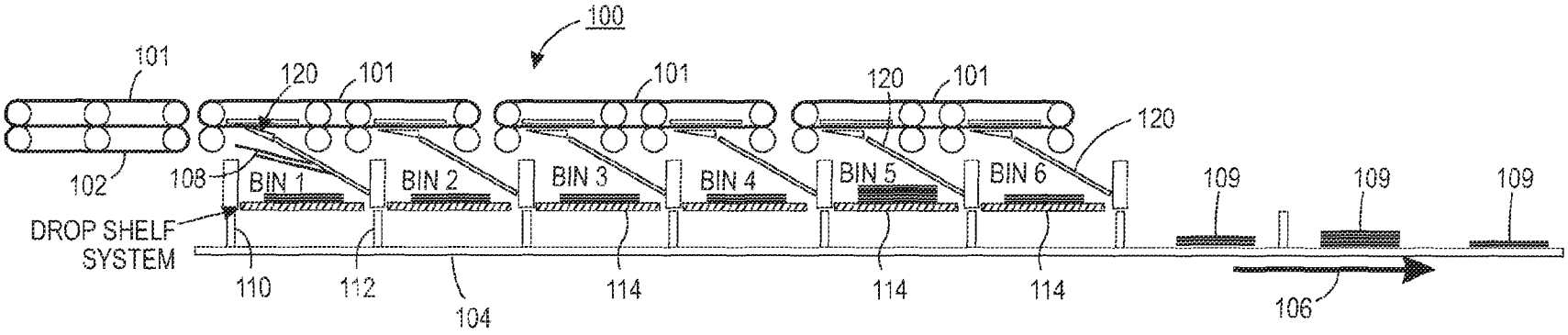
FIG. 1 is a schematic partial side view illustration of a multi-bin collation system with bins 2-6 already full and bin 1 in the process of being filled.

For a general understanding of the features of the disclosure, reference is made to the drawings. In the drawings, like reference numerals have been used throughout to identify identical elements.

In accordance with the present disclosure, two streams of greeting cards are provided with each stream sent to a series of bins by diverting the stream of cards to sequential bins based on customer meta data present on a header card for each set. The collation count is from 2 to over 100 cards per customer. The Bins are filled sequentially. That is, the first Bin to the right then the second from the right, etc., until all of the Bins are filled. The Bins are made up of 4 fixed vertical walls and a moveable floor that holds the collations and is retracted to drop the collation(s). The system works by filling 5 of the 6 Bins left to right, as view in FIG. 1, and then dropping the collated sets by way of a moveable floor onto a conveyor belt. When 5 of the 6 Bins are filled the sets are dropped leaving the $6^{th}$ Bin open to catch the next incoming card collation. The next 5 of 6 Bins are then filled right to left. An additional Bin can be used for any blank cards that are part of the architecture. Those cards are then dropped to an out-sort conveyor rather than the product conveyor if not banded. The number of Bins can be optimized as desired.

Broadly, the present system of FIG. 1 for collating, sorting and banding sets of media, i.e., system 100, includes drive belts 101 that mate with idler belts 102 and thereby drive greeting cards 110 into Bins 1 through 6. Each Bin includes a rear wall 110 and a front wall 112 and a retractable floor or drop shelf 114 that when retracted from beneath walls 110 and 112 allows a set of greeting cards to fall onto a conveyor 104 which is rotatable in the direction of arrow 106 to convey completed sets of cards downstream or in the cross-process direction of the Bins for further processing which could include banding of each card set. As shown in FIG. 1, Bins 2-6 have been filled and Bin 1 is in the process of being filled. It is at this point that retractable floors 114 are actuated for retraction and the cards dropped onto conveyor 104. In addition, individual card sets 109 that have been previously dropped from Bins 2-6 are shown downstream of the Bins and in route to be banded.

Figure 2:
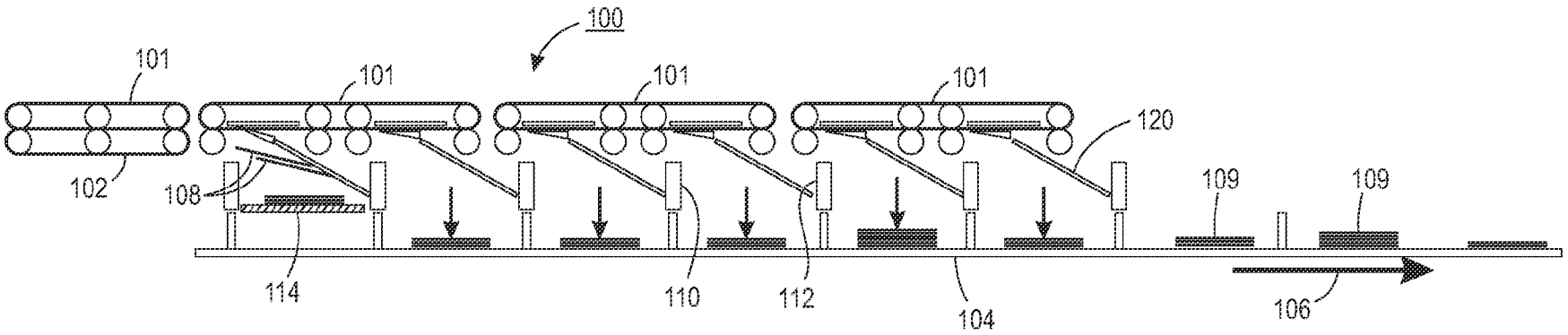
FIG. 2 is a schematic partial side view illustration of a multi-bin collation system of FIG. 1 with a drop shelf being retracted for bins 2-6 and collations dropped onto a conveyor.
Figure 3:
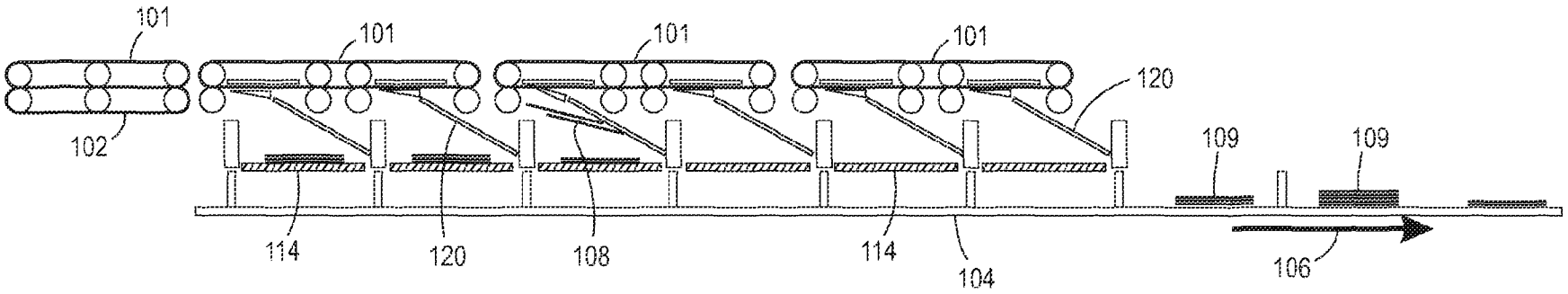
FIG. 3 is a schematic partial side view illustration of the multi-bin collation system of FIG. 1 showing greeting cards being collated into Bins 1-6 after a drop of greeting cards has been completed with the dropped cards moving downstream to a banding system.
Figure 4:
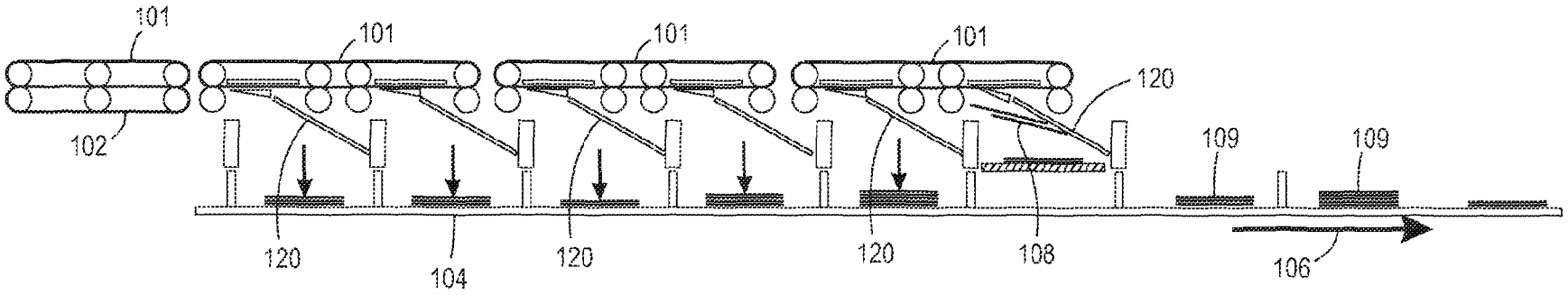
FIG. 4 is a schematic partial side view illustration of the multi-bin collation system of FIG. 1 showing the drop shelf system retracted for bins 1-5 and collations dropped onto a conveyor below.

In FIG. 2, collation system 100 is shown with floor 114 retracted from beneath Bins 2-6 and the collated card sets in Bins 2-6 having been dropped onto conveyor 104. It should be understood that dropping of cards from Bins 2-6 will not delay incoming cards because they are collected simultaneously in Bin 1. This allows for continuous flow of incoming cards and allows time for the drop. In FIG. 3, the multi-bin collation system is shown with cards being collated into Bins 1-6 after the drop has been completed and the dropped cards are moving downstream to a banding system. And in FIG. 4, the drop shelf system is shown retraced for Bins 1-5 and collations dropped to conveyor 104 below. No incoming card delay is experienced at the bander because cards are collected in Bin 6 as they are dropped from Bins 1-5. This allows for continuous flow of incoming cards and also allows time for the drop with respect to banding.

Depending on the banding tact time, it may be desired to out-sort smaller sets. This can be done with an additional Bin or Bins and a diverter to divert those sets to another non-banding conveyor system.

Figure 5:
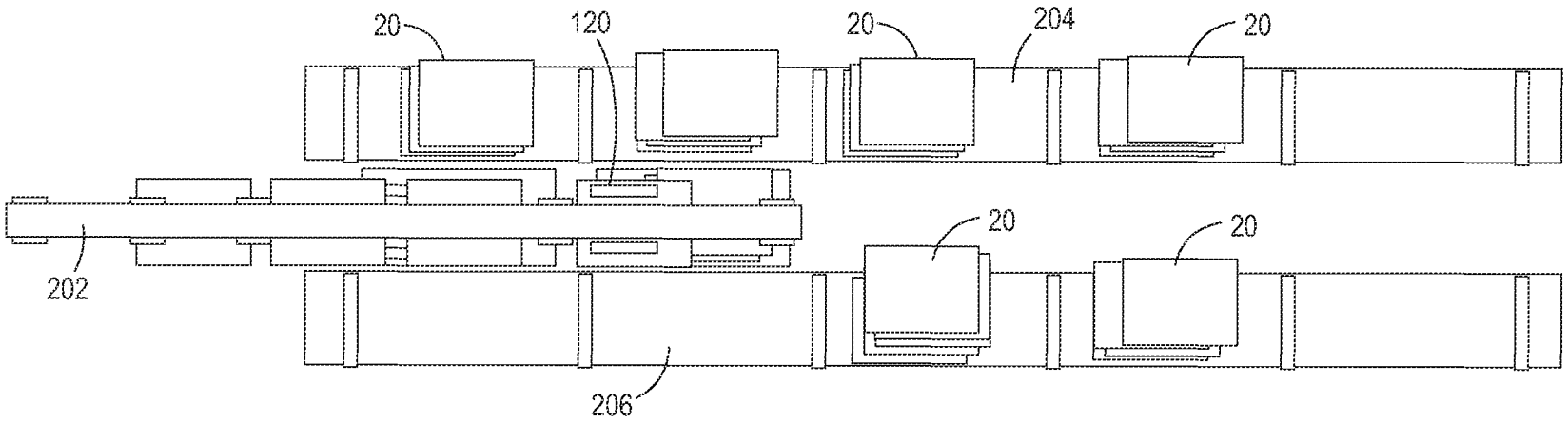
FIG. 5 is a plan view of an optional IB/OB system that accommodates a double bander per stream of greeting cards.

An optional or alternative inboard and or outboard arrangement 200 is shown in FIG. 5. that accommodates double banding per stream. This option reduces overall banding time and comprises a conveyor 202 that conveys collated sets of cards that have been dropped from Bins 1-6 and forwards them in the direction of conveyors 204 and 206. A diverter gate 120 is Up to divert cards down to the drop Bin. A conventional flighted pusher member (not shown) alternately pushes the card stacks from side to side off conveyor 202 onto conveyors 204 and 206.

Figure 6A:
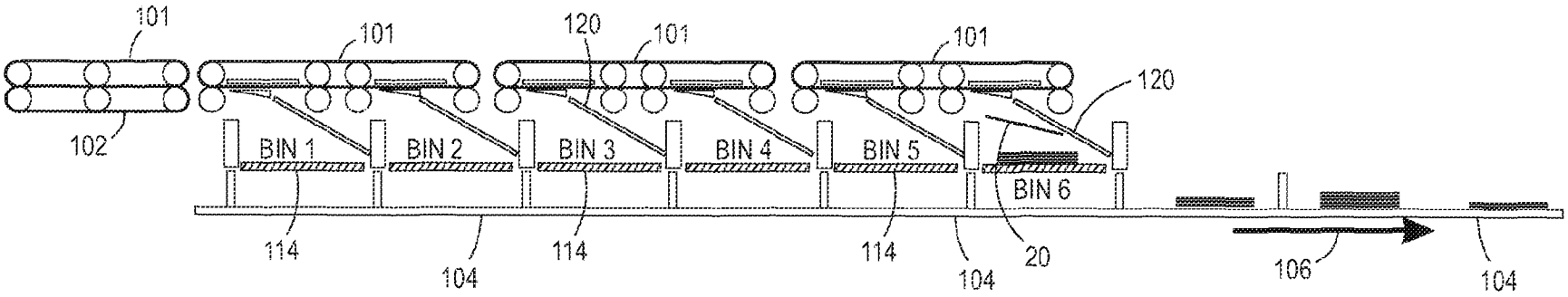
FIGS. 6A-6E show schematic partial side view illustrations of an alternative multi-bin collation system depicting how all of the card sets in the bins can be dropped at one time.
Figure 6B:
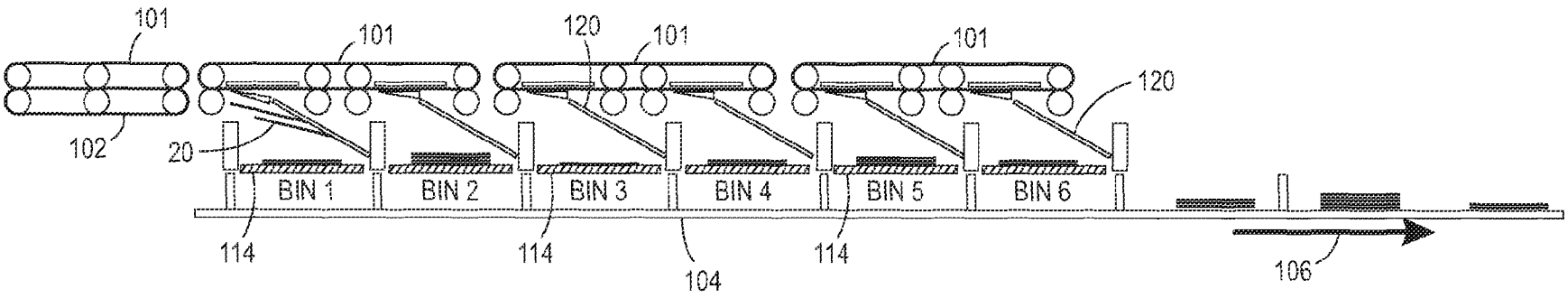
Figure 6C:
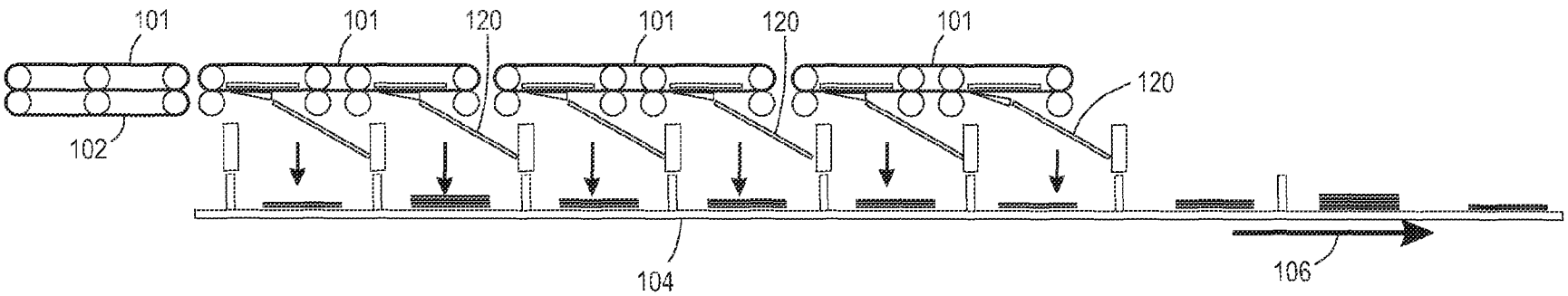
Figure 6D:
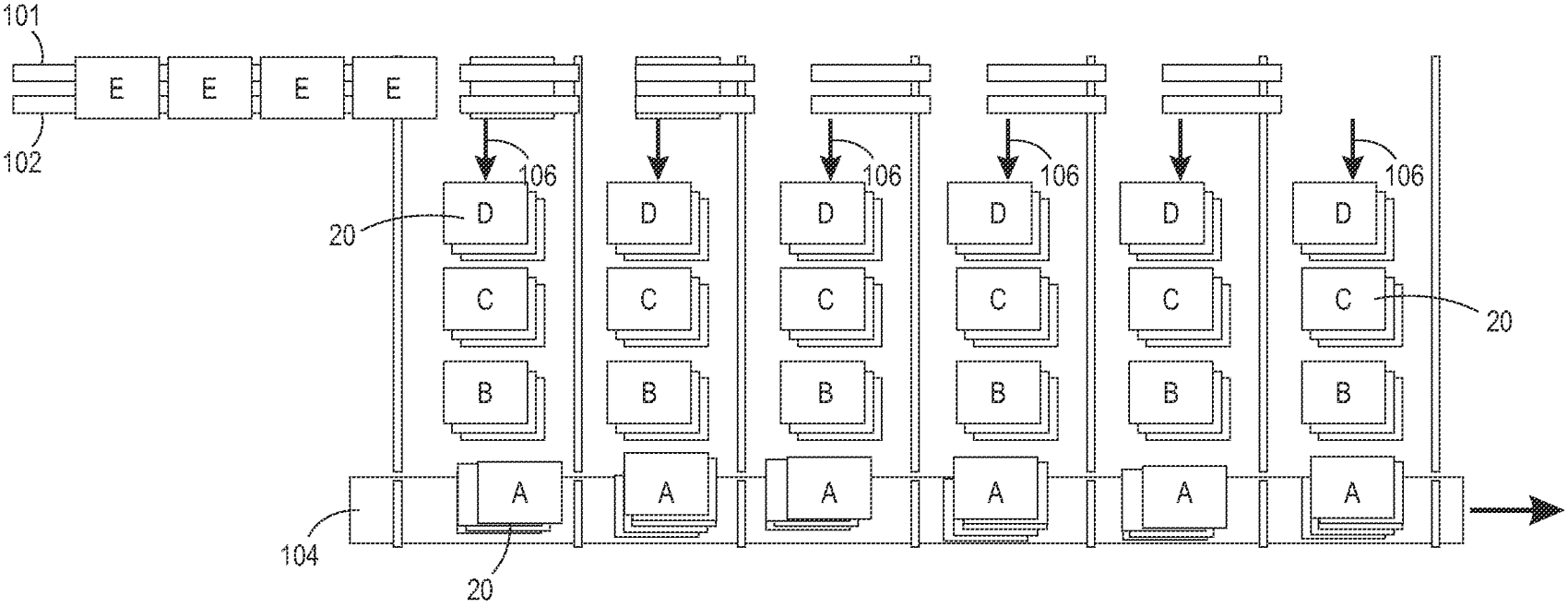
Figure 6E:
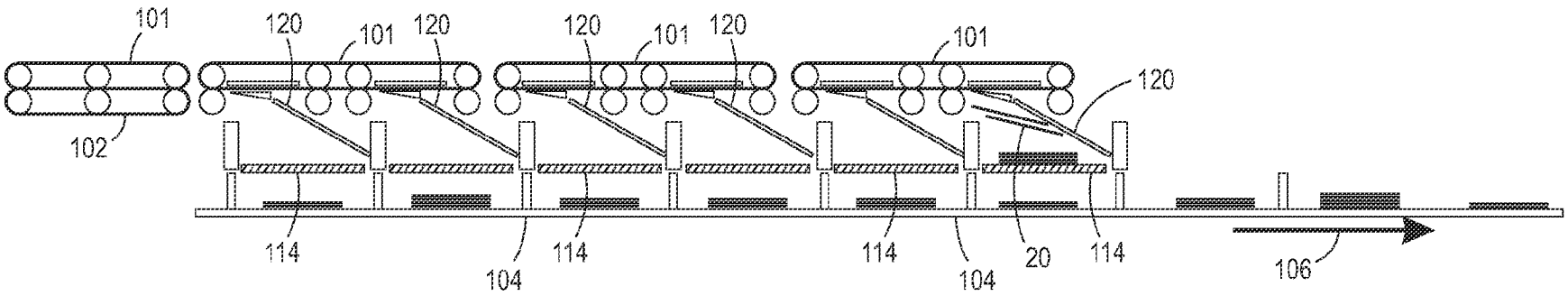

An alternative embodiment of the present disclosure is shown in FIGS. 6A-6E, with cards 20 in FIG. 6A being fed from an upstream source 101 and 102 in the direction of arrow 106 and deflected from the upstream feeder source into Bin 6 by diverter 120 and coming to rest on retractable floor 114. In this configuration, Bin 6 is the furthest Bin from the upstream source of cards 20 and is always the first Bin to be filled. In FIG. 6B all of the Bins have been filled except Bin 1 which is nearest to upstream feeder source 101 and is in the process of being filled. Once Bin 1 has been filled, retractable shelves or floors 114 in FIG. 6C are retracted and all of the completed sets are dropped in unison onto conveyor 104 for transport to a downstream processing station which could be a bander. In FIG. 6D, cards 20 are shown collated and then buffered in rows of 6 sets. That is, 6 sets of A, 6 sets of B, 6 sets of C and 6 sets of D. Here all rows of card sets A through D are indexed in unison in the direction of arrows 106 onto conveyor 104 simultaneously with card sets E entering into the bins. As shown in FIG. 6E, the completed sets of cards have been dropped and simultaneously with that dropping of completed card sets onto conveyor 104 a next or fresh set of cards 20 are traveling over diverters 120 and deflected into Bin 6. Dropping all of the card sets at one time enables the use of only one actuator to retract the Bin floors.

In practice, to meet a demand for collating, banding and sorting a high volume of greeting cards per printing, a fully automated high speed multi-bin card collation system 100 is disclosed that includes two streams of cards with each stream being sent to a series of 6 Bins. Diverters 120 channel or direct the stream of cards to sequential Bins based on customer requirements contained on a header sheet included for each requested set of cards which could be from 2 to over 100 cards per customer. The Bins are filled sequentially until 5 of the 6 Bins have been filled. Then a moveable bottom of each of, for example, Bins 2-6 is retracted allowing the collated sets of greeting cards to drop onto moving conveyor 104 leaving Bin 1 open to catch the next incoming card collation. Afterwards, conveyor 104 conveys the received collated card sets to a downstream processing station, such as, a banding apparatus that will place a band around each individual set of greeting cards. If desired, an additional Bin can be used for any blank cards that are part of the architecture. Those cards are then dropped to an out-sort conveyor rather than the product conveyor if not banded. The number of bins can by optimized to meet specific requirements.

Multi-bin card collation system 100 includes the ability to smooth card count collation time based on average set size by mixing small and large sets in multiple Bins prior to drop. It also minimizes actuator requirements for dropped sets by moving multiple bin drop shelves together and always provides at least one Bin for incoming cards to be collated while a drop sequence is occurring.

It should now be understood that a fully automated multi-bin card collation system has been disclosed that is capable of collating cards at high speed. The system takes die cut cards and diverts those cards on a customer by customer basis to multiple Bins. This increases the time that is allowed for moving the collated sets to the downstream process, e.g., automated banding systems. The system uses a series of Bins with each Bin including a diverter that is actuated between customer jobs to divert and collate the jobs independently. Each Bin includes a removable floor that allows the jobs to be collated prior to dropping onto a conveyor. This allows several Bins of cards to be collated and dropped simultaneously onto the conveyor while one bin is collecting the next set. The cards are collected right to left and then left to right allowing time to drop to equal the time it takes to fill all of the Bins minus the last Bin. The conveyor then actuates and the collated cards are conveyed out from under the Bins to a downstream position or directly to open bins of a bander.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for automatically collating sets of cards in a multi-bin collation system, comprising:

providing a series of bins for receiving individual sets of cards;

providing each of said series of bins with a retractable bottom portion;

providing a feed source for feeding cards over each of said series of bins;

providing a diverter for each of said series of bins for deflecting said sets of cards into separate of said series of bins;

filling a bin closest to said source first and then sequentially filling the rest of said series of bins with said sets of cards;

providing a first conveyor for transporting said sets of cards downstream from said series of bins;

simultaneously retracting said bottom portion of all of said series of bins except said bin most remote from said feed source while said bin most remote from said feed source is being filled and dropping said sets of cards from all of said series of bins except said bin most remote from said feed source onto said first conveyor; and including next filling said series of bins from said bin most remote from said source sequentially back towards said source.

2. The method of claim 1, wherein said series of bins includes at least three bins.

3. The method of claim 1, including providing said feed source as a series of mating drive belts and idler belts.

4. The method of claim 3, including providing second and third conveyors downstream of said series of multiple bins.

5. The method of claim 4, including a pusher for pushing said sets of cards from said first conveyor onto said second and third conveyors.

6. The method of claim 5, including alternately pushing said sets of cards onto said second and third conveyors.

7. The method of claim 6, including actuating said diverters in response to meta data on a cover sheet included with each card set request.

8. The method of claim 1, including providing card collation size buffering for varying distributions of card set sizes to allow for small sets to be offset by larger sets to increase average processing times for downstream systems.

9. A high speed multi-bin card collation system, comprising:

a series of bins arranged longitudinally with respect to each other;

a feed source for feeding cards over a top portion of said series of bins;

a diverter for each of said series of bins, said diverter being adapted when actuated to deflect a set of cards into selected ones of said series of bins;

a first conveyor for transporting sets of cards to a downstream location;

wherein a bin farthest from said source is the first to be filled and each of said series of bins includes a moveable card support surface, said card support surface being adapted to be retracted from beneath all of said series of bins simultaneously after all of said bins have been filled with card sets, and second and third conveyors positioned below and on opposite sides of said first conveyor and downstream of said series of bins.

10. The collation system of claim 9, wherein all of said sets of cards are dropped simultaneously from said series of bins except the closest of said bins to said source onto said first conveyor when they are filled.

11. The collation system of claim 10, including continuing to feed cards into said series of bins with said bin farthest from said source being the last bin to be filled.

12. The collation system of claim 9, wherein said second and third conveyors are adapted to receive collated card sets from said first conveyor.

13. The collation system of claim 12, wherein said card sets are placed onto said second and third conveyors alternately.

14. The collation system of claim 9, including a cover sheet having controlling data thereon for controlling the particulars of each set of cards.

* * * * *